US005601033A

United States Patent [19]

Ehrlich et al.

[11] Patent Number: 5,601,033

[45] Date of Patent: Feb. 11, 1997

[54] DOOR STRUCTURE FOR A RAILCAR IN AN ARTICULATED TRAIN

[75] Inventors: Donald J. Ehrlich, Lafayette; Rodney P. Ehrlich, Monticello; Francis S. Smidler; DeWayne B. Williams, both of Lafayette, all of Ind.

[73] Assignee: Wabash National Corporation, Lafayette, Ind.

[21] Appl. No.: 533,869

[22] Filed: Sep. 25, 1995

[51] Int. Cl.[6] ..... B61D 19/00

[52] U.S. Cl. ..... 105/355; 105/378; 105/410; 105/461

[58] Field of Search ..... 105/410, 378, 105/402, 355, 461; 160/210, 213; 296/55, 146.13

[56] References Cited

U.S. PATENT DOCUMENTS

| | | | |
|---|---|---|---|
| 3,977,123 | 8/1976 | Clay, Jr. | 105/410 X |
| 3,996,860 | 12/1976 | Ravani et al. | 105/410 X |
| 4,084,516 | 4/1978 | Ravani et al. | 105/410 X |
| 4,324,189 | 4/1982 | Roldness | 105/378 |
| 4,924,780 | 5/1990 | Hart | 105/378 |
| 5,255,952 | 10/1993 | Ehrlich . | |

FOREIGN PATENT DOCUMENTS

| | | | |
|---|---|---|---|
| 1150131 | 4/1985 | U.S.S.R. | 105/410 |

*Primary Examiner*—Mark T. Le
*Attorney, Agent, or Firm*—Trexler, Bushnell, Giangiorgi & Blackstone, Ltd.

[57] ABSTRACT

A novel door structure is provided for each end of a railcar in an articulated train. The train includes a plurality of railcars which are coupled together and spaced apart from each other a small distance. The door structure can be easily opened and closed even though the railcars in the train are only spaced apart from each other a small distance. A first embodiment of the novel door structure includes first and second door members, each of which have first and second panels that are hingedly connected together, which are attached to each end of each railcar. The first panel of each door member is foldable relative to the second panel and the panels are movable to lie adjacent to a side wall of the railcar. Structure is provided for connecting the door members to the sides of the railcar and for allowing the panels to rotate relative to the side of the railcar. A second embodiment of the novel door structure includes first and second door members, wherein the first door member is positioned at an upper portion of the end of the railcar and is movable to a lower portion of the railcar end to open an upper portion of the railcar end, and the second door member is positioned at a lower portion of the railcar end and is movable to an upper portion of the railcar end to open a lower portion of the railcar end.

16 Claims, 5 Drawing Sheets

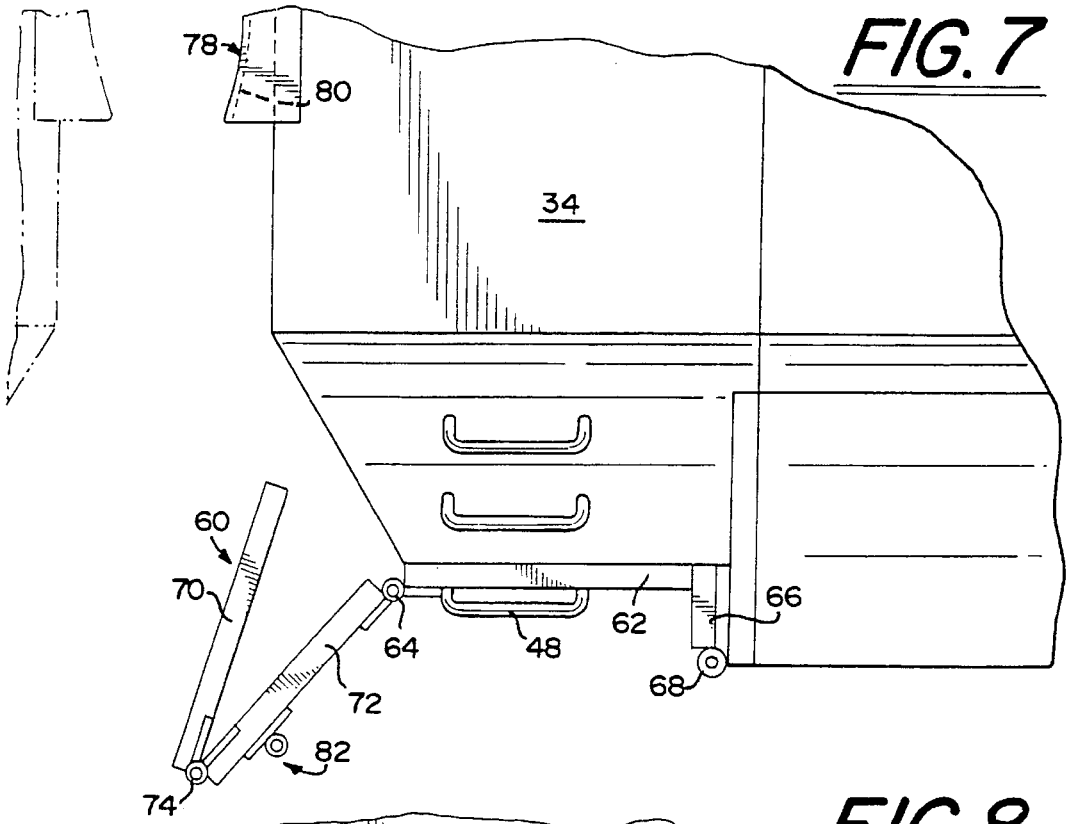
FIG. 7
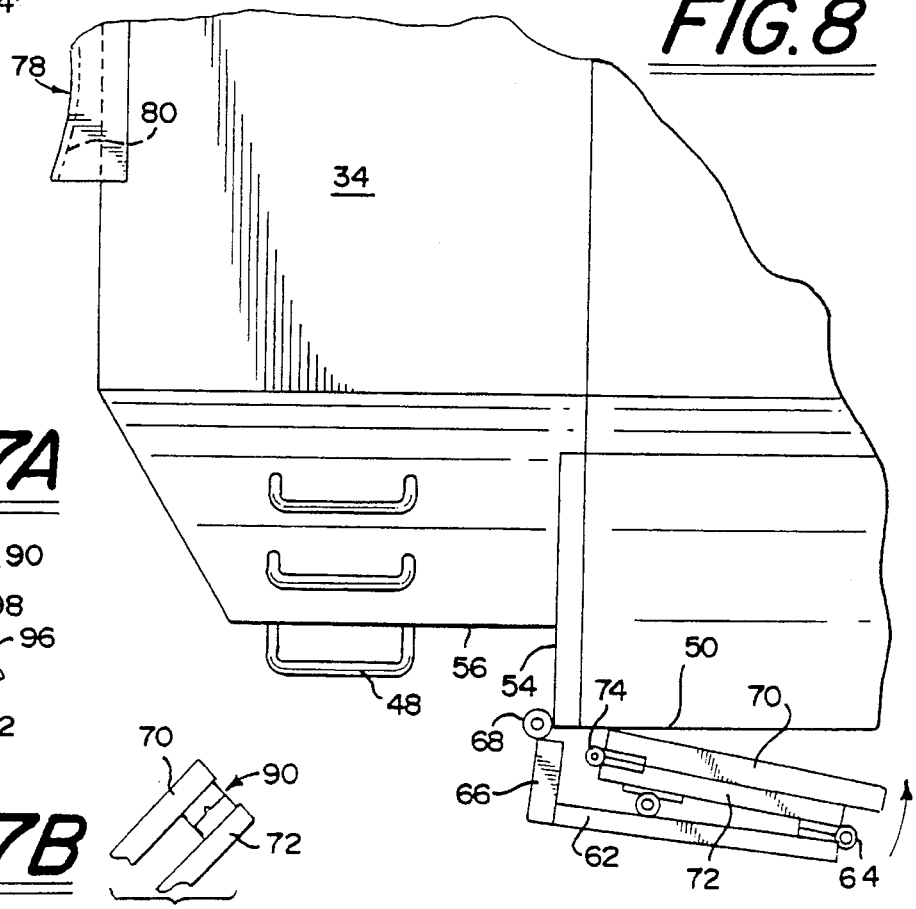
FIG. 8
FIG. 7A
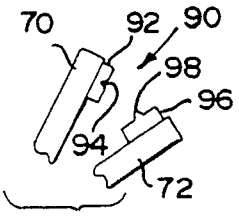
FIG. 7B

DOOR STRUCTURE FOR A RAILCAR IN AN ARTICULATED TRAIN

BACKGROUND OF THE INVENTION

This invention is generally directed to a novel door structure for a railcar in an articulated train. More particularly, the invention contemplates an articulated train having a plurality of connected, closely spaced freight or box railcars having the novel door structure of the present invention attached at each end of each railcar, wherein the door structure is capable of easily being opened and closed while the railcars are connected together.

When freight or box railcars are connected together in an articulated train, the individual railcars are only spaced apart from each other a distance of approximately eighteen inches. Conventionally, these railcars have doors on the sides of the railcar and a door on each end of the railcar. Generally, each of the doors is a single panel which swings opens outwardly to provide access to the interior of the railcar. When the railcars are connected together in the train, since the railcars are so closely spaced together, the door on each end of the railcar cannot be swung open since there is insufficient clearance for the door between the railcars. Therefore, the cargo must be loaded through the side doors of the railcar. Loading cargo in this manner presents a problem for forklifts since the forklift must be driven into the railcar and then swung sharply to the right or left to stack the cargo.

The present invention presents a novel door structure for the ends of a railcar in an articulated train which overcomes the problems presented by the prior art. The novel door structure of the present invention presents several other advantages and improvements which will become apparent upon a reading of the attached specification.

OBJECTS AND SUMMARY OF THE INVENTION

A general object of the present invention is to provide a novel door structure for a railcar in an articulated train.

An object of the present invention is to provide an articulated train having a plurality of connected, closely spaced freight or box railcars having the novel door structure of the present invention attached at each end of each railcar, wherein the door structure is capable of easily being opened and closed while the railcars are connected together to allow cargo to be loaded onto the rear of the train and thereafter be driven through the train.

Another object of the present invention is to provide a door structure for an articulated train which can be opened or closed while the railcars in the train are connected together so that cargo, such as automobiles, trucks or the like or general freight loaded onto forklifts, can be loaded through the last railcar in the train and driven through the entire train to the front to load the railcars quickly and easily.

Briefly, and in accordance with the foregoing, the present invention discloses a door structure for a railcar in an articulated train. The train has a plurality of closely spaced railcars which are coupled together. The door structure requires a minimal amount of clearance between the railcars and thus, can be easily opened and closed to open and close the end of the railcar, even though the railcars are only spaced apart from each other by a small distance.

Each railcar has a front end, a rear end and sides. A floor and a deck element are provided in the railcar for carrying cargo thereon. The floor and the deck element have deck plates attached thereto to provide a bridge between adjacent railcars so that cargo, such as automobiles and the like, can be driven from the rear end of the train, through each of the cars, to the front end of the train.

The door structure is provided on each end of each railcar in the train and includes a first door member and a second door member attached thereto. The door members open to open at least a portion of the end of the railcar and close to completely close the end of the railcar.

In a first embodiment of the novel door structure, the first door member and the second door member each have first and second panels. The first panel of each door member is hingedly connected to and foldable relative to the second panel. Structure is provided for connecting the door members to the sides of the railcar. Once the panels are completely folded relative to each other, the panels are movable to lie adjacent to the sides of the railcar.

The connecting structure includes tubes which are hingedly attached to each second panel at one end thereof and are rigidly connected to a bar at the other end thereof. The bar is connected to the side wall of the railcar by a plurality of hinges. To open the door members, the panels are folded relative to each other and then relative to the tubes. As the folded panels are rotated towards the tubes, the tubes are swung outwardly along the hinges until the door structure is positioned adjacent to the side wall of the railcar. To close the door members, the door structure is moved in the opposite manner.

In a second embodiment of the novel door structure, the first door member is positioned at an upper portion of the railcar end and is movable to a lower portion thereof to open an upper portion of the end of the railcar, and the second door member is positioned at a lower portion of the railcar end and is movable to an upper portion thereof to open a lower portion of the end of the railcar. When the first door member is moved downwardly, the deck within the railcar is exposed, and when the second door member is moved upwardly, the floor within the railcar is exposed. In this embodiment, the door members are connected to the interior of the side walls of the railcar proximate to the end of the railcar and are counterbalanced against each other. The bottom end of the first door member overlaps the upper end of the second door member and a gasket is provided between the bottom end of the first door member and the upper end of the second door member to seal the end of the railcar to prevent the entrance of dirt or moisture into the railcar between the door members.

In addition, each railcar has a ladder attached to the exterior of each side wall at an end thereof. Due to the construction of the novel door structure, the ladder is available for use when the door members are open or closed.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which:

FIG. 7 is a partial, top plan view of the railcar with the door structure in a partially open position, but in a position which is more open than that shown in FIG. 6;

FIG. 7A is a partial, top plan view of a structure for locking the panels of the door structure in a folded position shown with the panels apart from each other;

FIG. 7B is a partial, top plan view of a structure for locking the panels of the door structure in a folded position shown with the panels locked together;

FIG. 8 is a partial, top plan view of the railcar with the door structure in a fully open position;

DETAILED DESCRIPTION OF ILLUSTRATIVE EMBODIMENTS

Figure 1:
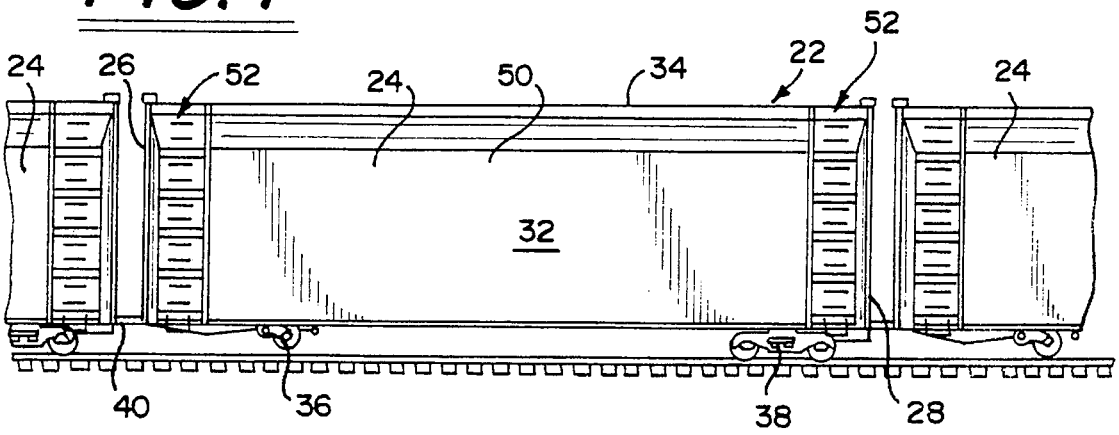
FIG. 1 is a side elevational view of an articulated train which incorporates the features of the invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

The present invention comprises a novel door structure 20, 20*a* that is used in a modular, articulated train, such as the train 22 shown in FIG. 1. The train 22 includes a plurality of individual box or freight railcars 24 which are connected together and are spaced apart from each other by a small distance, which, for example, may be approximately eighteen inches, when connected together. The novel door structure 20, 20*a* of the present invention can be easily opened or closed while the railcars 24 are coupled together, even though the railcars 24 are separated from each other by a very small distance. The railcars 24 in the train 22 can be used to haul automobiles, small trucks or the like or general freight. Each railcar 24 may be a freight railcar or a box car, or alternatively, each railcar 24 may be a bimodal trailer or the like.

Each railcar 24 in the train 22 has body which is formed from a front end 26, a rear end 28, a floor 30, a pair of upstanding side walls 32 which are connected to and extend upwardly from the floor 30 and a top wall or ceiling 34 which is connected to the upper ends of the side walls 32 to close the top end of the railcar 24 and to form a body structure. The front and rear ends 26, 28 of each railcar 24 in the train 22 have the novel door structure 20, 20*a*, as described herein, attached thereto to completely close the front and rear ends 26, 28 of the railcar 24 when the door structure 20, 20*a* is closed and to open the front and rear ends 26, 28 of the railcar 24 when the door structure 20, 20*a* is open to provide access into the interior of the railcar 24 through the ends of the railcar 24. The top wall 34 of each railcar 24 may have three wall members which are connected together, such that the outer, side wall members are slanted from the side walls to the middle wall which is horizontal. Alternatively, the top wall 34 of each railcar 24 may be flat. A door (not shown) may be provided on the side of the railcar 24, if desired, so that the railcar 24 can be loaded in a conventional manner.

A landing gear 36, which may have a railworthy, flanged wheel attached thereto, is attached to the underside of each railcar 24 along a front portion thereof. A conventional railroad bogie 38 is attached to the underside of each railcar 24 along a rear portion thereof. A coupling mechanism 40 which includes a tongue/socket/retractable pin combination, which may be made in accordance with the coupling mechanism disclosed in U.S. Pat. No. 5,297,858, which is commonly owned by the assignee herein, and which disclosure is herein incorporated by reference, is attached to the front and rear ends 26, 28 of each railcar 24 to couple the railcars 24 together.

A deck member 42 is provided within each railcar 24 upon which freight, automobiles, small trucks or the like can be loaded. The deck member 42 can be stationary or can be movable such that it can be positioned to abut against the floor 30 and raised to be spaced from the floor 30 by a suitable lifting mechanism and thereafter attached to the side walls 32 of the railcar 24 to secure the deck member 42 in place. Such a lifting mechanism and structure for attaching the deck member 42 is disclosed in co-pending U.S. patent application, Ser. No. 08/534,275 filed Sep. 27, 1995, entitled "Modular Articulated Railcar", which is commonly owned by the assignee herein, and which disclosure is herein incorporated by reference.

A pair of deck plates or bridge plates 44 are attached to each of the floor 30 and the deck member 42 within the railcar 24. The deck plates 44 are used to provide a bridge between two adjacent railcars 24 so that an automobile, small truck, forklift or the like can be driven from one end of the train 22, through the railcars 24, to the opposite end of the train 22. The deck plates 44 are preferably attached to the front end of the deck member 42 and to the front end of the floor 30 of the railcar 24. Alternatively, one deck plate can be provided on the rear end of the forward railcar and the other deck plate can be provided on the front end of the following railcar. The deck plates 44 can flip up, slide in, etc., relative to the floor 30 and the deck member 42 so as to keep the deck plates 44 out of the way when not needed.

A ladder 46, which is required by law, is attached to the exterior of each side wall 32 proximate to each end 26, 28 of each side wall 32. Each ladder 46 has a plurality of spaced apart rungs 48. The ladders 46 allow an operator to climb up each side of the railcar 24 and access the deck member 42 within the railcar 24. Each ladder 46 is available for use when the door structure 20, 20*a* is open or closed.

Figure 9:
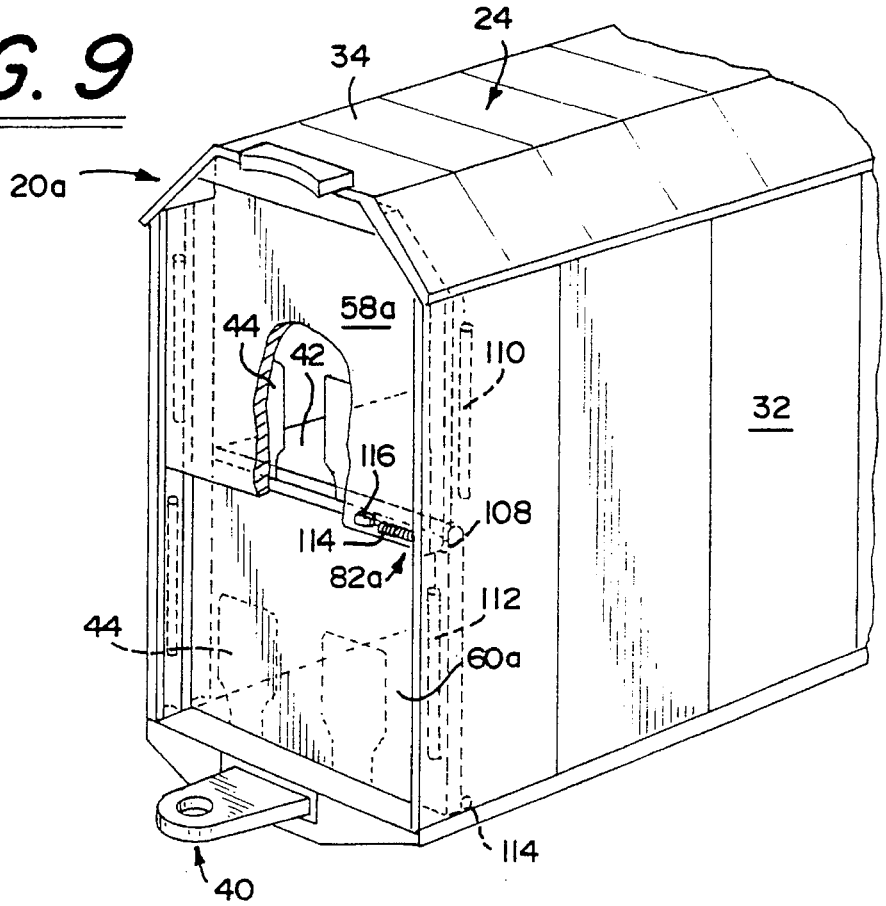
FIG. 9 is a perspective view of a second embodiment of a novel door structure which incorporates the features of the present invention with the door structure in a closed position.
Figure 10:
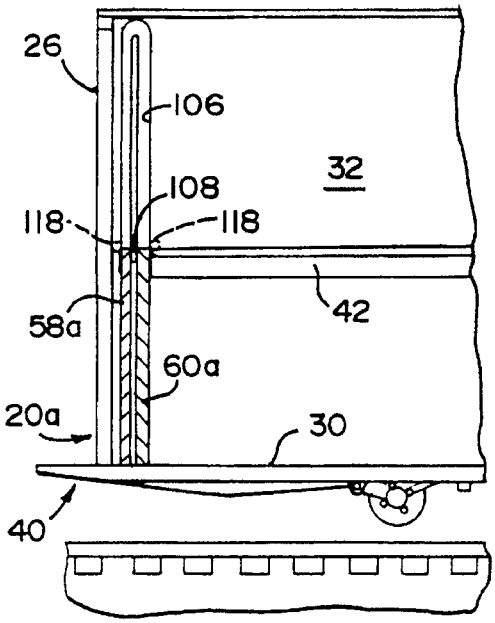
FIG. 10 is a cross-sectional view of the door structure shown in FIG. 10, with one of the door members of the door structure opened to provide a clear passageway between decks in adjacent railcars.
Figure 11:
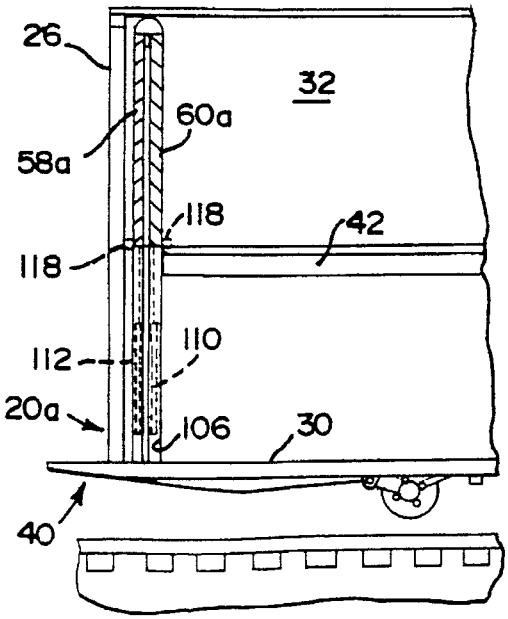
FIG. 11 is a cross-sectional view of the door structure shown in FIG. 10, with one of the door members of the door structure opened to provide a clear passageway between floors in adjacent railcars.

A first embodiment of the novel door structure 20 which incorporates features of the present invention is shown in FIGS. 2–8. A second embodiment of the novel door structure 20*a* which incorporates features of the present invention is shown in FIGS. 9–11. A description of the first embodiment of the door structure 20 is set forth first and thereafter, a description of the second embodiment of the door structure 20*a* is set forth. Like elements in the second embodiment of the door structure 20*a* to that of the first embodiment of the door structure 20 are denoted by like reference numerals with the suffix "a" thereafter.

Attention is now directed to the specifics of the first embodiment of the novel door structure 20 shown in FIGS. 2–8 and the structure of the railcar 24 used therewith. The specifics of the railcar 24 and the first embodiment of the novel door structure 20 are described with respect to a front end 26 of one of the railcars 24, with the understanding that the rear end 28 and the door structure provided thereon is identical in construction and function.

Each side wall 32 of the railcar 24 includes a main wall portion 50 which extends along substantially the entire length of the side wall 32 and a recessed wall portion 52 which is proximate to the end 26 of the railcar 24. The recessed wall portion 52 includes a first wall section 54 which is perpendicular to the main wall portion 50 and a second wall section 56 which is parallel to the main wall portion 50. The individual rungs 48 of the ladder 46 are attached to the exterior of the second wall section 56 of the railcar 24 and the outermost extent of the rungs 48 do not extend past the main wall portion 50.

As best illustrated in FIGS. 5–8, the end 26 of the railcar 24 has a middle section 51 and outer sections 53. The middle section 51 is perpendicular to the second wall section 56. The outer sections 53 are angled outwardly from the second wall section 56 to the middle section 51.

The door structure 20 is comprised of a first door member 58 and a second door member 60, each of which has an inner end and an outer end. The door members 58, 60 are sized so as to completely cover the end 26 of the railcar 24 when the door members 58, 60 are closed. The outer ends of the door members 58, 60 correspond in shape to the side walls 32 of the railcar 24. The upper and lower ends of the door members 58, 60 correspond in shape to the floor 30 and the ceiling 34, respectively, of the railcar 24. When the door members 58, 60 are in a closed position, the inner ends of the door members 58, 60 tightly abut against each other.

The outer ends of each of the door members 58, 60 are connected to the respective side wall 32 of the railcar 24 by a connecting structure which includes a plurality of spaced apart, horizontally arranged tubes 62 which are formed from a suitable material, such as steel. A first end of each tube 62 is connected to the respective outer end of each door member 58, 60 by a hinge 64. The second end of each tube 62 is rigidly connected to a vertical bar 66. The tubes 62 lie flat against the second wall section 56 of the recessed wall portion 52 when the door structure 20 is closed around the end 26 of the railcar 24. Each tube 62 is positioned between adjacent rungs 48 in the ladder 46 so that the rungs 48 of the ladder 46 are not obstructed by the tubes 62. Since the tubes 62 extend between ladder rungs 48, the ladder 46 can be used to climb up the side wall 32 of the railcar 24 by an operator when the door structure 20 is closed.

The vertical bar 66 is attached to each side wall 32 of the railcar 24 by a plurality of spaced hinges 68 along the length thereof, each of which allows the bar 66 to rotate relative to the respective side wall 32 of the railcar 24. The bar 66 is connected via hinges 68 to the corner between the main wall portion 50 of the side wall 32 and the first wall section 54. The bar 66 lies flat against the first wall section 54 and has a width which is equal to the first wall section 54. Alternatively, the bar 66 may be connected to the juncture between the first wall section 54 and the second wall section 56 by hinges.

Each of the first and second door members 58, 60 have first and second panels 70, 72 which are connected together by a plurality of hinges 74 so that the first panel 70 can be folded relative to the second panel 72. The hinges 74 are positioned so as to divide each door member 58, 60 approximately in half. The second panel 72 of each door member 58, 60 is hingedly connected to the tubes 62 at its outer end by the hinges 64.

When the door members 58, 60 are closed, the end 26 of the railcar 24 is completely closed to prevent the entrance of dirt and moisture into the interior of the railcar 24. The second panel 72 of each door member 58, 60 closes over the outer section 53 of the end 26 of the railcar 24 and the first panel 70 of each door member 58, 60 closes over half of the middle section 51 of the end 26 of the railcar 24. Thus, when the door structure 20 is in the closed position, the panels 70, 72 are angled relative to each other. A sealing structure, such as a gasket, may be provided along the length of the juncture of the door members 58, 60 and between the door members 58, 60 and the end 26 of the railcar 24.

A conventional locking mechanism 82 is provided for locking the door members 50, 52 in the closed position. The locking mechanism 82 may take the form of an elongate shaft 84 having a handle 86 attached thereto. The upper and lower ends of the shaft 84 are each releasably engaged with a member 88, from which the ends of the shaft 84 can be disengaged upon turning the handle 86.

Figure 2:
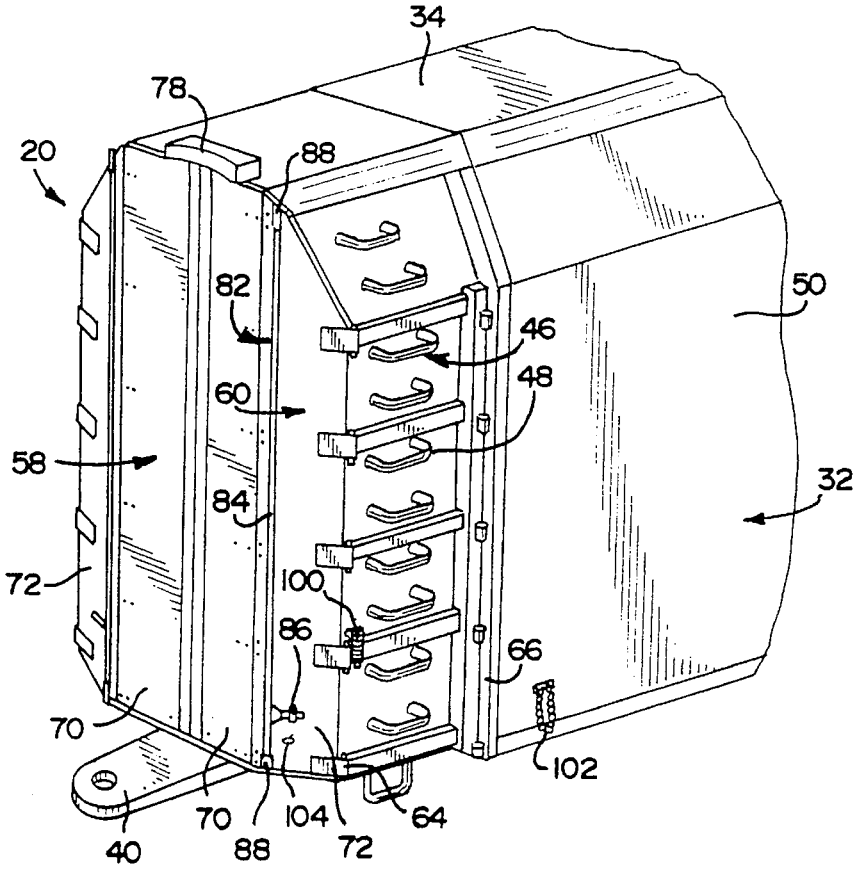
FIG. 2 is a perspective view of a first embodiment of a novel door structure which incorporates the features of the present invention with the door structure in a closed position.
Figure 5:
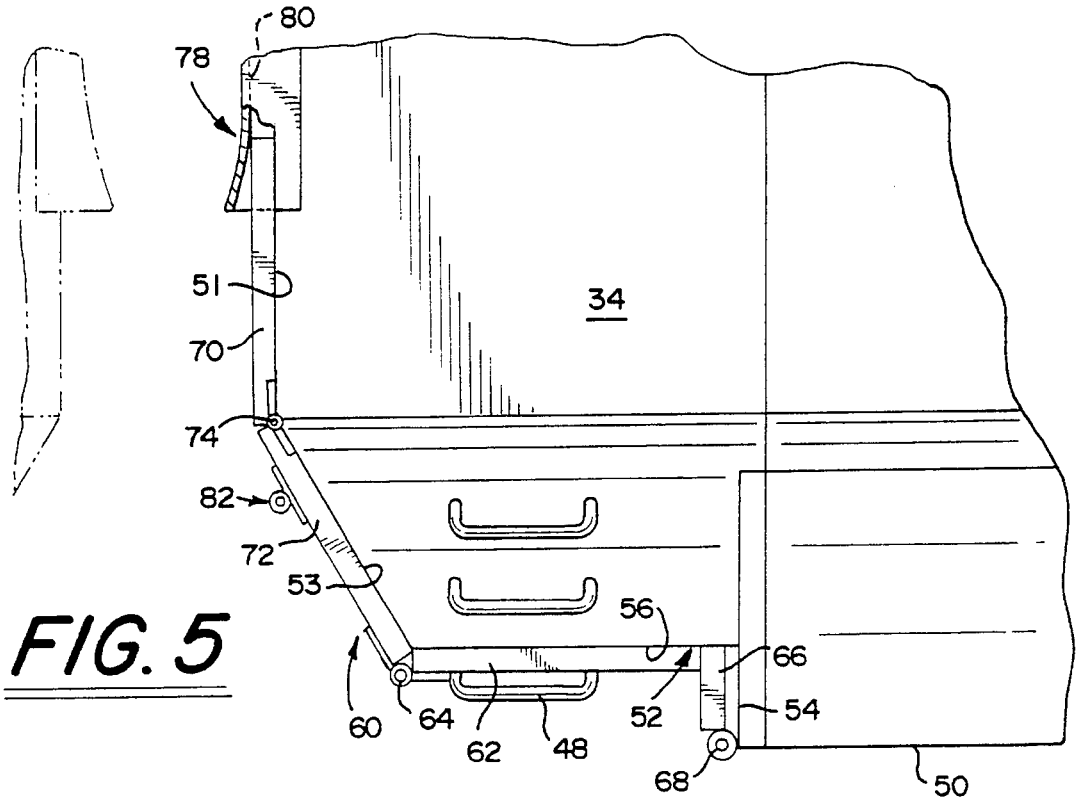
FIG. 5 is a partial, top plan view of the railcar with the door structure in a closed position.

As shown, the door members 58, 60 are attached to the railcar 24 by the connecting structure described hereinabove and by a guide mechanism 78 which is mounted on the top wall 34 at the middle of the middle section 51. The guide mechanism 78 is a track 80 which is attached to the top wall 34 of the railcar 24 and which receives a top portion of each first panel 70 therein as illustrated in FIGS. 2 and 5. A guide mechanism, like that provided on the top wall 34 of the railcar, may be provided on the floor 30 of the railcar 24 at the middle of the middle section 51 for receiving a bottom portion of each first panel 70 therein.

Now that the construction of the first embodiment of railcar 24 and the novel door structure 20 have been described, the method of opening the door structure 20 is described and attention is directed to FIGS. 5–8. The method is described by setting forth how the door member 60 is opened with the understanding that the method for opening door member 58 is the same. The method is carried out manually.

Figure 6:
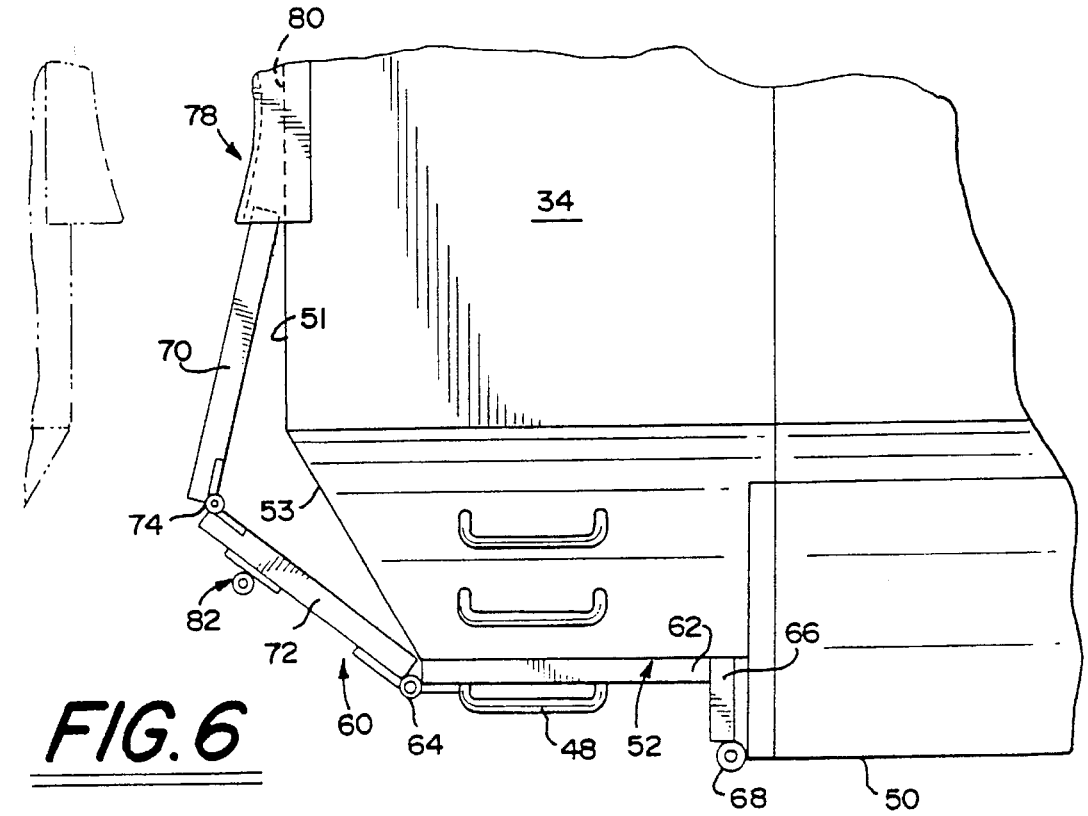
FIG. 6 is a partial, top plan view of the railcar with the door structure in a partially open position.

The door structure 20 is shown in its closed position in FIG. 5 and as described hereinabove. To open the door member 60, first, the locking mechanism 82 is disengaged so that the panels 70, 72 can be moved relative to the end 26 of the railcar 24. Thereafter, as shown in FIG. 6, the panels 70, 72 are moved outwardly until the top end of the first panel 70 clears the guide mechanism track 80. As the panels 70, 72 move outwardly, the panels 70, 72 fold inwardly relative to each other along the hinges 74. Once the top end of the first panel 70 completely clears the guide track 80, the partially folded first and second panels 70, 72 move outwardly towards the side wall 32 to clear the end 26 of the railcar 24 as shown in FIG. 7.

The panels 70, 72 are folded relative to each other along hinges 74 until they are completely folded over onto each other. As shown in FIGS. 7A and 7B, a locking mechanism 90 may be provided to lock the panels 70, 72 into the folded position so that the panels 70, 72 can be easily handled. The locking mechanism 90 may take the form of a member 92 having a recess 94 therein which is mounted on the inner side of the first panel 70 which accepts a protrusion 98 on a member 96 that has a shape which is complementary to the recess 94 which is mounted on the inner side of the second panel 72. When the panels 70, 72 are completely folded relative to each other, the protrusion 98 is accepted into the recess 94 and securely held therein by a friction-fit. Other mechanisms for locking the panels 70, 72 relative to each other are within the scope of the invention.

Up to this point in the opening of the door member 60, the tubes 62 do not pivot outwardly from the side wall 32. The tubes 62 may be prevented from swinging or moving outwardly by a dead bolt lock 100. The dead bolt lock 100 is connected to the second wall section 56 and partially extends over one of the tubes 62 when engaged. To disengage the dead bolt lock 100, the bolt is retracted from its engagement with the tube to allow the tubes 62 to swing outwardly. Other mechanisms for preventing the tubes 62 from prematurely rotating are within the scope of the invention.

After the dead bolt lock 90 has been disengaged, the tubes 62 are free to pivot outwardly relative to the side wall 32 of the railcar 24. The folded panels 70, 72 are swung outwardly which causes the tubes 62 to swing outwardly relative to the side wall 32. As the tubes 62 swing outwardly, the bar 66 pivots outwardly relative to the first wall section 54 via the hinges 68.

The folded panels 70, 72 are thereafter folded towards the tubes 62 via the hinges 74 until the folded panels generally abut against the tubes 62. The folded panels 70, 72 and tubes 64 are then rotated toward the main wall section 50 of the side wall 32.

Figure 4:
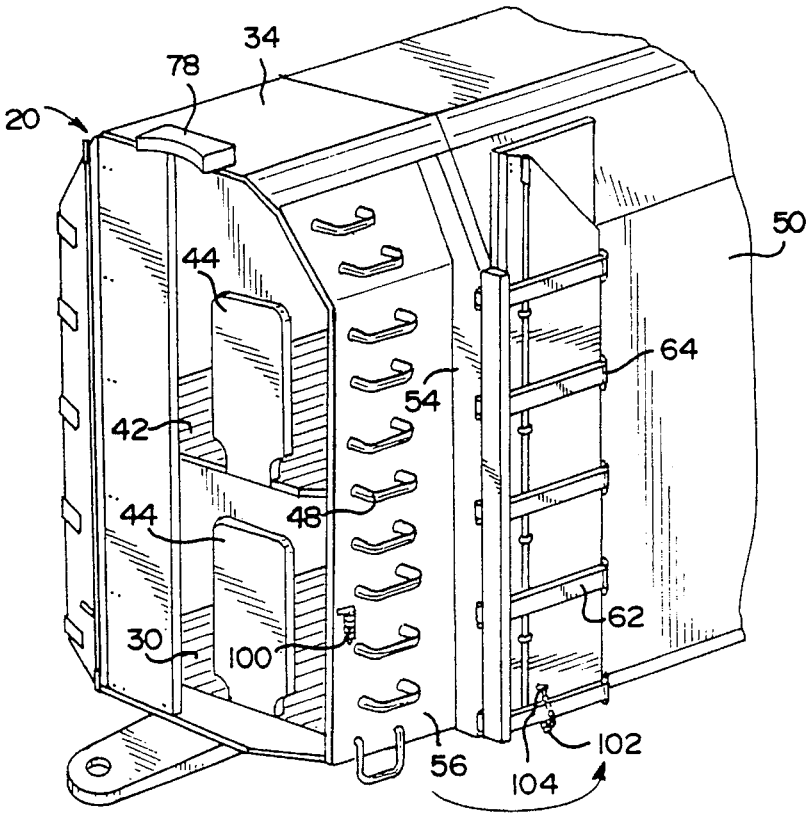
FIG. 4 is a perspective view of the door structure shown in FIG. 2, with one of the door members of the door structure completely opened to show the interior of the railcar.

When the door structure 20 is in its final, open position, as shown in FIGS. 4 and 8, the folded first and second panels 70, 72 are proximate to the main portion 50 of the side wall 32 and the tubes 62 are adjacent to and overlie the folded first and second panels 70, 72. The ladder 46 is completely unencumbered by the door structure 20. Since the door members 58, 60 do not substantially pivot outwardly towards the railcar 24 in front (shown in phantom lines) or behind the railcar 24 when the door structure 20 is being opened, the door structure 20 requires a minimal amount of clearance to completely open the end 26, 28 of the railcar 24.

Depending on which way the hinge 74 between the first and second panels 70, 72 allows the panels 70, 72 to rotate relative to each other, the first panel 70 may abut against the tubes 62 or the second panel 72 may abut against the tubes 62. It is envisioned that the panels 70, 72 do not need to be folded relative to each other when the door structure 20 is in the final, open position and instead, the panels 70, 72 may be unfolded relative to each other. In addition, depending on which way the hinge 74 allows the panels 70, 72 to rotate relative to the tubes 62, the tubes 62 may abut against the main wall section 50 or the panels 70, 72 may abut against the main wall section 50.

Figure 3:
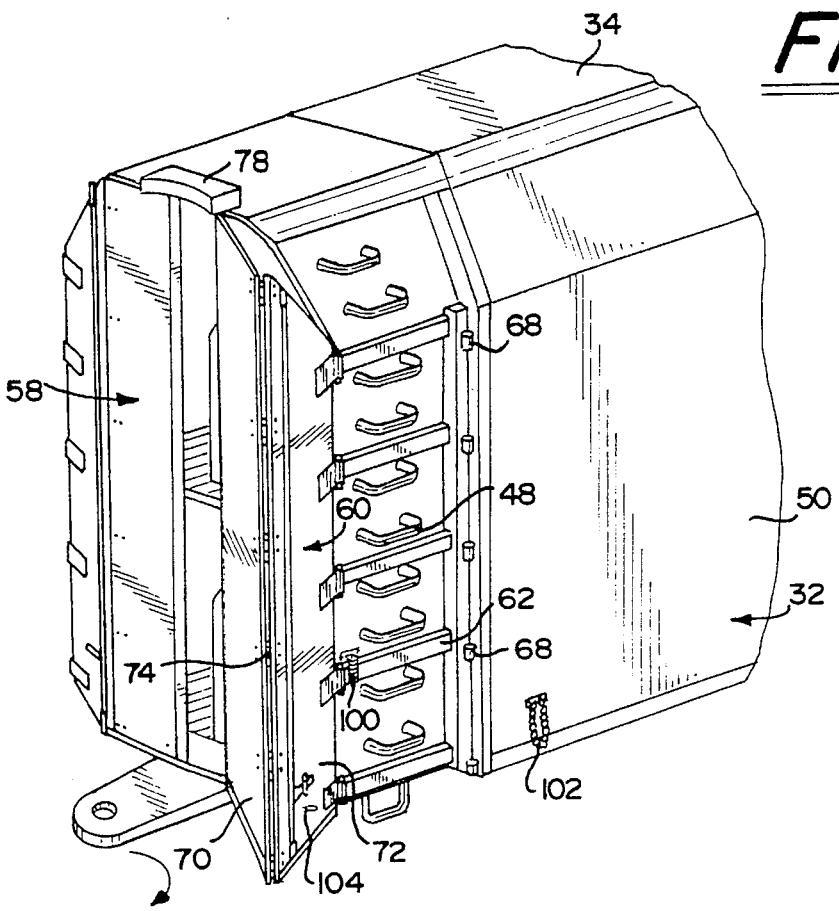
FIG. 3 is a perspective view of the door structure shown in FIG. 2, with one of the door members of the door structure partially opened.

As shown in FIGS. 2–4, a chain 102 may be attached to the main portion 50 of the side wall 32 which has a hook on its opposite, free end. The second panel 72 includes a ring 104 thereon for engagement with the hook on the end of the chain 102 when the door structure 20 is in its final, open position. Other mechanisms for securing the door structure 20 in its open position are within the scope of the invention.

After both door members 70, 72 have been opened, as described hereinabove, the ends 26, 28 of the railcar 24 are completely open and unencumbered by any door structure 20. The deck plates 44 are moved into position between the two railcars 24 to provide a bridge between the two railcars 24 so that cargo, such as automobiles, small trucks, a forklift carrying general freight or the like, can be easily driven from one end of the train 22, through the line of railcars 24, to the opposite end of the train 22. The cargo can be loaded onto either the deck member 42 or the floor 30, or onto both at the same time. Therefore, the cargo can be quickly and easily loaded into the articulated train 22.

To close the door structure 20, the opposite steps are carried out. The tubes 62 and folded panels 70, 72 are rotated outwardly relative to the main wall section 50 of the side wall 32. The folded panels 70, 72 are then swung outwardly at the hinge 64 relative to the tubes 62 and are pivoted relative to each other along hinge 74 until they are slightly folded relative to each other. Thereafter, the panels 70, 72 are swung towards the end 26 of the railcar thereby rotating tubes 62 towards the side wall 32 of the railcar 24. As the first panel 70 slides over the end 26 of the railcar 24, the top end of the first panel 70 re-engages with the guide track 80. The panels 70, 72 are moved until the panels 70, 72 completely close around the end 26 of the railcar 24.

Attention is now directed to the second embodiment of the novel door structure **20*a* of the present invention which is shown in FIGS. 9–11. The specifics of the second embodiment of the novel door structure 20*a* is described with respect to a front end 26 of one of the railcars 24, with the understanding that the door structure 20*a*** provided on the rear end thereof is identical in construction and function.

As shown in the drawings, in this embodiment the recessed portion 52 in the first embodiment of the railcar is eliminated, but may be incorporated into the design if desired. In addition, the end 26 of the railcar 24 is flat, but may take a form similar to that shown in the first embodiment of the railcar if desired.

The door structure **20*a* generally takes the form of a guillotine or vertical acting door and is comprised of an upper or first vertical door member 58*a* and a lower or second vertical door member 60*a*. The sides of the door members 58*a*, 60*a* conform in shape to the side walls 32 of the railcar 24 and are engaged within a generally U-shaped track 106 on the interior of the side walls 32 of the railcar 24 proximate to the end 26 of the railcar 24. The profile of the top end of the upper door member 58*a* corresponds in shape to the profile of the ceiling 34 of the railcar 24 and the lower end of the upper door member 58*a* overlaps the upper end of the lower door member 60*a*. The profile of the lower end of the lower door member 60*a* corresponds in shape to the floor 30 of the railcar 24**.

When the door members **58*a*, 60*a* are in a closed position, the inner face of the lower end of the upper door member 58*a* overlaps and tightly abuts against the outer face of the upper end of the lower door member 60*a*. A gasket 108 or other suitable sealing structure is provided at the juncture between the upper and lower door members 58*a*, 60*a* to prevent the entrance of dirt or moisture within the interior of the railcar 24 when the door structure 20*a* is closed. In addition, the overlap of the upper door member 58*a* over the lower door member 60*a* allows any rain which falls on the railcar 24 to run off onto the ground and not into the interior of the railcar 24**.

The outer ends of the door members **58*a*, 60*a* are engaged within each of one of the legs of the generally U-shaped track 106 by suitable means, such as rollers or by merely being in contact with the track 106. Each of the door members 58*a*, 60*a* has a counterbalanced weight 110, 112** attached thereto by suitable means, such as a cable. The door members 58*a*, 60*a* are capable of being manually slid along the length of the track 106 so as to move the door members 58*a*, 60*a* relative to each other and relative to the side walls 32 of the railcar 24.

The outer door member 58*a* has a locking mechanism 82*a* at the bottom thereof and the inner door member 60*a* has a locking mechanism 82*a* at the bottom thereof. The locking mechanism 82*a* may take the form of a manually retractable, spring biased pin 114 having handle 116 attached thereto which is engaged within a retaining aperture 118 in the side wall 32 of the railcar 24. The retaining apertures 118 are approximately at the midpoint of the side wall 32 so that when a door member 58*a*, 60*a* is positioned in an upper position at the top of the end 26 of the railcar 24, the pin 114 engages within the aperture 118 to secure the door member 58*a*, 60*a* in the upper position. The pin 114 is biased into engagement within the retaining aperture 228 to prevent downward movement of the door structure 20*a*.

When the door structure 20*a* is closed, the upper door member 58*a* is positioned at the upper portion of the railcar end 26 such that the top end of the door member 58*a* abuts against the ceiling 34. The pin 114 on the lower end of the upper door member 58*a* is engaged within the retaining aperture 118 on the side wall 32 of the railcar 24 to secure the door member 58*a* in the upper position. The lower door member 60*a* is positioned at the lower portion of the end 26 such that the bottom end of the door member 60*a* abuts against the floor 30. The pin 114 on the lower door member 60*a* is not engaged within the retaining aperture 118 on the side wall 32 of the railcar 24 and the door member 60*a* is held in place by gravity. A suitable locking mechanism may be provided to lock the lower door member 60*a* in the lower position, if desired.

To open the top portion of the end 26 to expose the deck member 42 within the railcar 24, the pin 114 is moved out of its engagement with the retaining aperture 118 by pulling the handle 116 inwardly to compress the spring. Thereafter, the top door member 58*a* is slid downwardly so as to be adjacent to the lower door member 60*a*, as shown in FIG. 10. Likewise, to open the lower portion of the end 26 to expose the floor 30 within the railcar 24, the lower door member 60*a* is slid upwardly so as to be adjacent to the top door member 58*a*, as shown in FIG. 11. Once the lower door member 60*a* is slid all of the way up, the pin 114 engages within the retaining aperture 118 to securely hold the door member 60*a* in the upper position. The counterbalanced weights 110, 112 provide for the easy sliding of the door members 58*a*, 60*a*. Since the door members 58*a*, 60*a* do not pivot outwardly towards the railcar 24 in front or behind the railcar 24 to which the door members 58*a*, 60*a* are attached, the door structure 20*a* requires a minimal amount of clearance to open the end 26, 28 of the trailer 24.

Once the desired door member 58*a*, 60*a* is opened, the deck plates 44 are moved into position between the two railcars 24 to provide a bridge between the two railcars 24 so that cargo, such as automobiles, small trucks, a forklift carrying general freight or the like, can be easily driven from the rear end of the train, through the line of railcars 24, to the opposite end of the train. Therefore, the cargo can be quickly and easily loaded onto the articulated train.

While the door structure 20*a* has been described with only a single deck member 42 therein, it is envisioned that more than one deck member may be provided within the railcar 24. The door structure 20*a* could be easily modified to provide access to the other deck members. For example, the lower door member could cover the end portion of the railcar which permits access to the area between the floor and the lower deck, the upper door member could cover the end portion of the railcar which permits access to the area between the ceiling and the top deck, and a third vertical door member could be provided to cover the end of the railcar which would permit access to the area between the upper and lower decks.

While embodiments of the present invention are shown and described, it is envisioned that those skilled in the art may devise various modifications of the present invention without departing from the spirit and scope of the appended claims.

The invention claimed is:

1. A railcar for an articulated train having a plurality of railcars which are connected together and spaced apart from each other by a small distance, said railcar comprising a body having an interior and an exterior and includes a front end, a rear end and sides and having a door structure including a first door member and a second door member attached to at least one end of said body, said door members opening to open at least a portion of said end of said body, said door members closing to close said end of said body, said first door member and said second door member each having first and second panels, said first panels of said door members being foldable relative to said second panels of said door members, and further including structure for connecting said door members to said body, said connecting structure including a first pivot structure proximate to said end of said body around which said panels can rotate open said end of said body, and a second pivot structure around which said panels can rotate to move said panels and said first pivot structure away from said end of said body to lie adjacent to said exterior of said sides of said body.

2. A railcar as defined in claim 1, which includes said door structure at both of said ends of said body.

3. A railcar as defined in claim 1, wherein said connecting structure comprises tubes attached to each said second panels at said first pivot structure and connected to each side of said body at said second pivot structure.

4. A railcar as defined in claim 3, wherein said second pivot structure attaches said tubes to each side of said body, said second pivot structure comprising a rotatable bar attached to said tubes such that rotation of said tubes rotates said rotatable bar to open or close said door members.

5. A railcar as defined in claim 3, further including a hinge structure between each said first and second panels of said door members to allow said first panels to fold relative to said second panels.

6. A railcar as defined in claim 5, wherein said body has a floor and a deck therein and further including at least one deck plate attached to said floor and said deck.

7. A railcar as defined in claim 6, wherein said body has a ladder attached to the exterior of at least one of said sides of said body, said ladder being free for use when said door members are open or when said door members are closed.

8. A railcar as defined in claim 5, further including structure for securing said door members to said end of said body when said door members are in a closed position.

9. A railcar as defined in claim 5, further including structure for securing said panels together when said panels are folded relative to each other.

10. A railcar as defined in claim 5, further including structure for securing said door members to said side of said body when said door members are in an open position.

11. A railcar as defined in claim 1, wherein said ladder is positioned between said first pivot structure and said second pivot structure.

12. An articulated train comprising: a plurality of individual railcars, said railcars being closely spaced apart from each other and connected together by connecting structure, each said railcar having an interior and an exterior and a front end, a rear end and sides; and a door structure provided on at least one end of each said railcar, said door structure comprising a first door member and a second door member, said door members being movable to an open position to open at least a portion of said end and being movable to a closed position to close said end of each said railcars, said first door member and said second door member each having first and second panels, said first panels of said door members being foldable relative to said second panels of said door members, and further including structure for connecting said door members to said railcar, said connecting structure including a first pivot structure proximate to said end of said railcar around which said panels can rotate to open said end of said railcar, and a second pivot structure around which said panels can rotate to move said panels and said first pivot structure away from said end of said railcar to lie adjacent to said exterior of said sides of said railcar.

13. An articulated train as defined in claim 12, wherein said connecting structure comprises tubes attached to said second panels at said first pivot structure and connected to said sides of said railcars at said second pivot structure, said second pivot structure comprising a rotatable bar attached to said tubes such that rotation of said tubes rotates said rotatable bar to open or close said door members.

14. An articulated train as defined in claim 12, wherein said ladder is positioned between said first pivot structure and said second pivot structure.

15. A railcar for an articulated train having a plurality of railcars which are connected together and spaced apart from each other by a small distance, said railcar comprising a body which includes a front end, a rear end and sides and having a door structure including a first door member and a second door member attached to at least one end of said body, said door members opening to open at least a portion of said end of said body and said door members closing to close said end of said body, said first door member and said second door member each have first and second panels, said first panels of said door members being foldable relative to said second panels of said door members, and tubes attached to each said second panel and connected to each side of said body for connecting said door members to said body, said panels being movable to lie adjacent to said sides of said body, and a rotatable bar for attaching said tubes to each side of said body, said rotatable bar attached to said tubes such that rotation of said tubes rotates said rotatable bar to open or close said door members.

16. An articulated train comprising: a plurality of individual railcars, said railcars being closely spaced apart from each other and connected together by connecting structure, each said railcar having a front end, a rear end and sides; and a door structure provided on at least one end of each said railcar, said door structure comprising: a first door member and a second door member attached to said end, said door members being movable to an open position to open at least a portion of said end and being movable to a closed position to close said end of each said railcars, said first door member and said second door member of said door structure each have first and second panels, said first panels of said door members being foldable relative to said second panels of said door members, and further including tubes attached to said second panels for connecting said door members to said railcars, said panels being movable to lie adjacent to said sides of said railcars, said tubes being attached to said second panels and connected to said sides of said railcars and a rotatable bar attached to said tubes such that rotation of said tubes rotates said rotatable bar to open or close said door members.

* * * * *